US010077912B2

(12) United States Patent
Hong et al.

(10) Patent No.: US 10,077,912 B2
(45) Date of Patent: Sep. 18, 2018

(54) DEHUMIDIFIER AND METHOD FOR CONTROLLING OPERATION OF DEHUMIDIFIER

(71) Applicant: COWAY CO., LTD., Chungcheongnam-do (KR)

(72) Inventors: Hyun-Jin Hong, Seoul (KR); Chan-Jung Park, Seoul (KR); Dong-Hui Jang, Seoul (KR); Hyun-Goo Kim, Seoul (KR)

(73) Assignee: COWAY CO., LTD., Chungcheongnam-do (KR)

( * ) Notice: Subject to any disclaimer, the term of this patent is extended or adjusted under 35 U.S.C. 154(b) by 161 days.

(21) Appl. No.: 15/038,780

(22) PCT Filed: Nov. 20, 2014

(86) PCT No.: PCT/KR2014/011169
§ 371 (c)(1),
(2) Date: May 24, 2016

(87) PCT Pub. No.: WO2015/080429
PCT Pub. Date: Jun. 4, 2015

(65) Prior Publication Data

US 2016/0377310 A1 Dec. 29, 2016

(30) Foreign Application Priority Data

Nov. 29, 2013 (KR) ..... 10-2013-0147130
Nov. 17, 2014 (KR) ..... 10-2014-0159955

(51) Int. Cl.
*F24F 3/14* (2006.01)
*F24F 11/83* (2018.01)
*F24F 11/00* (2018.01)

(52) U.S. Cl.
CPC ..... *F24F 3/14* (2013.01); *F24F 11/0008* (2013.01); *F24F 11/83* (2018.01); *F24F 2003/1446* (2013.01)

(58) Field of Classification Search
CPC ..... F24F 3/14; F24F 11/0008; F24F 11/83; F24F 2003/1446
(Continued)

(56) References Cited

U.S. PATENT DOCUMENTS

2002/0170305 A1* 11/2002 Nakajima ..... B60H 1/3222 62/228.4
2009/0277197 A1* 11/2009 Gambiana ..... F25B 39/028 62/115

FOREIGN PATENT DOCUMENTS

CN 1427213 7/2003
CN 1566831 1/2005
(Continued)

OTHER PUBLICATIONS

Korean Office Action for KR 10-2014-0159955 dated Apr. 10, 2017, 5 pages.

*Primary Examiner* — Marc Norman
(74) *Attorney, Agent, or Firm* — Dority & Manning, P.A.

(57) ABSTRACT

The dehumidifier, according to one embodiment of the present invention, comprises: a variable compressor which varies the rotation speed of a driving shaft according to an input control signal and adjusts an amount of a refrigerant gas compressed by the rotation of the driving shaft; a condenser for liquefying the compressed refrigerant gas received from the variable compressor; a heat exchanger for cooling flown air by vaporizing the liquefied refrigerant gas, and condensing vapors of the flown air into water to remove the water by using the cooling air; a blower fan for supplying outside air to the heat exchanger by forming an air flow according to the driving speed of a blower motor; and a
(Continued)

control unit for generating the control signal according to the input signal so as to adjust the rotation speed of the driving shaft.

6 Claims, 3 Drawing Sheets

(58) Field of Classification Search
USPC ..... 62/151, 178, 180, 186, 228.1, 228.4
See application file for complete search history.

(56) References Cited

FOREIGN PATENT DOCUMENTS

| | | |
|---|---|---|
| EP | 1443278 | 8/2004 |
| JP | 579678 | 3/1993 |
| JP | 2001221458 | 8/2001 |
| JP | 2002349934 | 12/2002 |
| KR | 10-0512281 | 8/2004 |
| KR | 20050042108 | 5/2005 |
| KR | 20130022386 | 8/2012 |
| WO | WO 2012177072 | 8/2012 |

* cited by examiner

DEHUMIDIFIER AND METHOD FOR CONTROLLING OPERATION OF DEHUMIDIFIER

CROSS-REFERENCE TO RELATED APPLICATIONS

This application is the U.S. National Stage entry of international Application Number PCT/KR2014/011169 having a filing date of Nov. 20, 2014, which is based upon and claims priority to Korean Patent Application Serial Number 10-2014-0159955, having a filing date of Nov. 17, 2014, and Korean Patent Application Serial Number 10-2013-0147130, having a filing date of Nov. 29, 2013, the disclosures of all of which are hereby incorporated by reference herein in their entirety for all purposes.

TECHNICAL FIELD

The present invention relates to a dehumidifier and a method for controlling an operation of a dehumidifier and, more particularly, to a dehumidifier having increased dehumidification efficiency using a variable compressor and a method for controlling an operation of a dehumidifier.

BACKGROUND ART

Indoor air is required to contain an appropriate degree of humidity (for example, 40% to 60%) to help prevent respiratory problems or the spread of disease and to create an agreeable indoor atmosphere. If humidity is excessively high in the air, decomposition, corrosion, and water condensation may occur, while odors say be present and bacteria may grow, and thus, it is essential to adjust a degree of humidity in the air.

In general, humidity in the air may be adjusted using a dehumidifier. The dehumidifier may remove humidity in the air using a refrigerating cycle including a compressor, a condenser, and a heat-exchanger. That is, vapor contained in the air may be removed by condensing it into water through a heat-exchanger. Here, as the compressor, a fixed-type compressor may generally be used, and an amount of dehumidification way be adjusted by controlling an amount of power supplied to the fixed-type compressor.

However, in the fixed-type compressor, power supply and cutoff are repeated during a dehumidification operation, and thus, when power is supplied or cut off, an over current may be instantly applied. In particular, the overcurrent may operate a power circuit breaker to cause an interruption of an operation of the entire dehumidifier, resulting in user inconvenience and a degradation of product reliability due to the frequent interruption of the operation of the dehumidifier.

DISCLOSURE

Technical Problem

Therefore, an object of the present invention is to provide a dehumidifier having increased dehumidification efficiency using a variable compressor, and a method for controlling an operation of a dehumidifier.

Technical Solution

According to an aspect of the present invention, there is provided a dehumidifier including: a variable compressor adjusting an amount of a refrigerant gas compressed according to rotation of a driving shaft by varying a rotation speed of the driving shaft according to an input control signal; a condenser liquefying the compressed refrigerant gas supplied by the variable compressor; a heat-exchanger vaporizing the liquefied gas to cool introduced air, and condensing vapor in the introduced air into water to remove the water using the cooling air; a blower fan forming an air flow according to a driving speed of a blower motor to supply ambient air to the heat-exchanger; and a control unit generating the control signal according to an input signal to adjust a rotation speed of the driving shaft. Here, the control unit may receive an ambient humidity value measured by an ambient humidity sensor, as the input signal, and when the ambient humidity value is within a preset target humidity range, the control unit may adjust the rotation speed of the driving shaft to a preset humidity maintaining speed.

Also, when power starts to be supplied to the variable compressor, the control unit may output an initial start-up control signal for limiting the rotation speed of the driving shaft to a speed below a preset initial start-up speed during a preset start-up time.

Also, the control unit may further include a function of adjusting a driving speed of the blower motor of the blower fan by generating the control signal.

In this case, the control unit may receive a measurement current value measured by a current measurement device measuring a magnitude of a current supplied to the variable compressor, as the input signal, and when the measurement current value is above a preset overload current value, the control unit may output a safety control signal for reducing the rotation speed of the driving shaft to a preset safety speed and increasing the driving speed of the blower motor of the blower fan to a speed above a preset reference speed.

Also, the control unit may receive a measurement temperature value measured by a temperature sensor measuring a surface temperature of the heat-exchanger, as the input signal, and when the measurement temperature value is below a preset condensation temperature, the control unit may output an anti-condensation control signal for reducing the rotation speed of the driving shaft to a preset anti-condensation speed and increasing the driving speed of the blower motor of the blower fan to a speed above a preset reference speed.

According to another aspect of the present invention, there is provided a method for controlling an operation of a dehumidifier which compresses a refrigerant gas using a variable compressor, liquefies the compressed refrigerant gas with a condenser, and vaporizes the refrigerant gas with a heat-exchanger to cool introduced air to thus remove vapor from the introduced air, including: a control signal generating operation of generating a control signal for adjusting an amount of a refrigerant gas compressed by the variable compressor according to an input signal; and a compression adjusting operation of adjusting an amount of the refrigerant gas compressed by the variable compressor by varying a rotation speed of a driving shaft by the variable compressor according to the control signal.

Here, the control signal generating operation may include: an initial start-up process in which when power starts to be supplied to the variable compressor, an initial start-up signal for limiting the rotation speed of the driving shaft to a speed below a preset initial start-up speed during a preset start-up period is generated; and a humidity maintaining process in which when an ambient humidity value measured by an ambient humidity sensor is within a preset target humidity range, a maintaining control signal for adjusting the rotation speed of the driving shaft to a preset humidity maintaining speed is generated.

Also, the control signal generating operation may generate a control signal for adjusting an amount of a refrigerant gas compressed by the variable compressor and a driving speed of a blower motor of a blower fan according to the input signal, and the method may further include a blowing adjusting process in which an amount of air introduced to an interior of the dehumidifier is adjusted by adjusting the driving speed of the blower motor of the blower fan according to the control signal.

The control signal generating operation may include: a safety control process in which when, a magnitude of a current supplied to the variable compressor is above a preset overload current value, a safety control signal for reducing the rotation speed of the driving shaft to a preset safety speed and increasing the driving speed of the blower motor of the blower fan to a speed above a preset reference speed is generated; and an anti-condensation process in which when a measurement temperature value measured by a temperature sensor measuring a surface temperature of the heat-exchanger is below a preset condensation temperature, an anti-condensation control signal for reducing the rotation speed of the driving shaft to a preset anti-condensation speed and increasing the driving speed of the blower motor of the blower fan to a speed above a preset reference speed is generated.

The foregoing technical solutions do not fully enumerate all of the features of the present invention. The foregoing and other objects, features, aspects and advantages of the present invention will become more apparent from the following detailed description of the present invention when taken in conjunction with the accompanying drawings.

Advantageous Effects

In the dehumidifier and the method for controlling an operation of a dehumidifier according to exemplary embodiments of the present invention, since a rotation speed of the driving shaft of the variable compressor is varied, the number of operations of a power circuit breaker may be significantly reduced.

Also, in the dehumidifier and the method for controlling an operation of a dehumidifier according to exemplary embodiments of the present invention, since a rotation speed of the driving shaft of the variable compressor is varied according to ambient humidity and a surface temperature of the heat-exchanger, a dehumidification operation may be stably performed and power consumption efficiency may be increased.

Also, in the dehumidifier and the method for controlling an operation of a dehumidifier according to exemplary embodiments of the present invention, an overload state may be effectively resolved by increasing heat exchange efficiency by adjusting a driving speed of the blower motor of the blower fan, as well as the rotation speed of the driving shaft of the variable compressor.

BEST MODE FOR INVENTION

Figure 1:
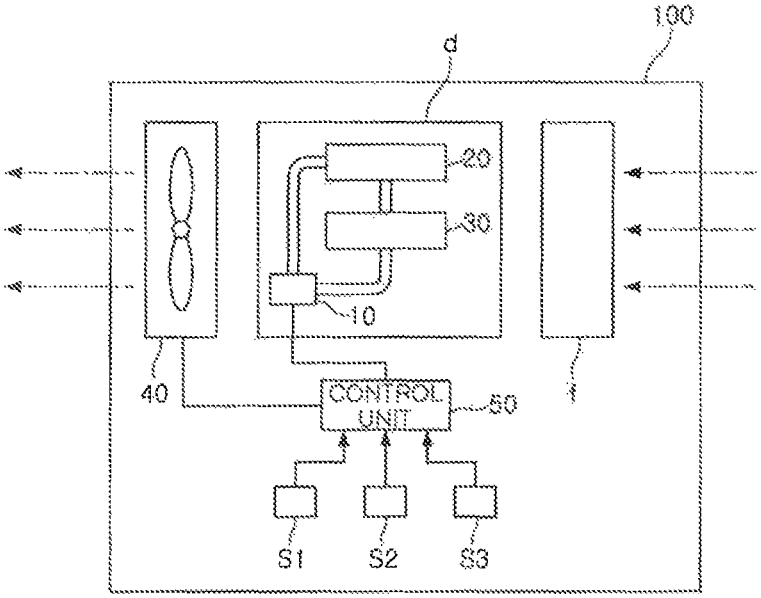
FIG. 1 is a block diagram illustrating a dehumidifier according to an exemplary embodiment in the present invention.

Hereinafter, embodiments will be described in detail with reference to the accompanying drawings such that they can be easily practiced by those skilled in the art to which the present invention pertains. In describing the present invention, if a detailed explanation for a related known function or construction is considered to unnecessarily divert the gist of the present invention, such explanation will be omitted but would be understood by those skilled in the art. Also, similar reference numerals are used for the similar parts throughout the specification.

It will be understood that when an element is referred to as being "connected to" another element, it can be directly connected to the other element or intervening elements may also be present. In contrast, when an element is referred to as being "directly connected to" another element, no intervening elements are present. In addition, unless explicitly described to the contrary, the word "comprise" and variations such as "comprises" or "comprising," will be understood to imply the inclusion of stated elements but not the exclusion of any other elements.

FIG. 1 is a block diagram illustrating a dehumidifier according to an exemplary embodiment in the present invention.

Referring to FIG. 1, a dehumidifier 100 according to an exemplary embodiment in the present invention may include a variable compressor 10, a condenser 20, a heat-exchanger 30, a blower fan 40, and a control unit 50.

A filter unit f may filter out contaminants included in the air introduced to an interior of the dehumidifier 100, That is, the filter unit f may remove a contaminant in a manner of adsorbing the contaminant in the air introduced to the interior of the dehumidifier 100. As illustrated, the filter unit f may be positioned in an intake port. According to another exemplary embodiment, the filter unit f may be divided into a first filter unit and a second filter unit which may be positioned in an intake port and an exhaust port of the dehumidifier 100, respectively. The first filter unit may include a prefilter and a functional filter, and the second filter unit may include a high efficiency particulate air (HEPA) filter, a deodorization filter, and the like. The prefilter may remove relatively large dust, hair, pet hair, and the like, and the functional filter may remove pollen, house ticks, germs, bacteria, and the like. Also, the HEPA filter may remove fine dust, various microorganisms such as indoor mold, and the like, and the deodorization filter may serve no remove various types of bad smell, harmful gases, and the like, in an indoor area. Here, any filter may be included in the filter unit f as long as it is generally used in the dehumidifier 100, and the like.

The blower fan 40 is rotated by a blower motor, and may form an air flow according to a driving speed of the blower motor. That is, the blower fan 40 may introduce ambient air to am interior of the dehumidifier 100 using the air flow. In particular, the blower fan 40 may supply ambient air to the heat-exchanger 30 so that a dehumidification operation may be performed on the ambient air.

Also, a driving speed (that is, revolutions per minute (RPM)) of the blower motor of the blower fan 40 may be adjusted by the control unit 50 as described hereinafter. Thus, an amount of air introduced to the interior of the dehumidifier 100 may be increased to increase heat-exchange efficiency, if necessary, such as in an overloaded state or such as in a case in which a temperature is below a condensation temperature, whereby an overloaded state may be effectively resolved, and dehumidification efficiency may be enhanced.

A dehumidifying unit d may remove vapor from the introduced air. In detail, the dehumidifying unit d may cool introduced, air to reduce an amount of saturated water vapor that may be included in the air, and in this case, vapor exceeding the amount, of the saturated water vapor may condense into water, resulting in lowering an amount of vapor included in the air, that is, humidity. Here, the dehumidifying unit d may induce a phase change in a refrigerant gas using the variable compressor 10, the condenser 20, and the heat-exchanger 30, and cool air introduced to the dehumidifier 100 using an endothermic reaction according to the phase change in the refrigerant gas. That is, when the variable compressor 10 compresses a refrigerant gas, the condenser 20 may liquefy the compressed refrigerant gas, and as the liquefied refrigerant gas is vaporized and expanded in the heat-exchanger 30, ambient air may be cooled. Thereafter, the refrigerant gas may be introduced again to the variable compressor 10 and compressed therein. That is, the refrigerant gas may repeatedly cool introduced air, while circulating in the variable compressor 10, the condenser 20, and the heat-exchanger 30.

Figure 2A:
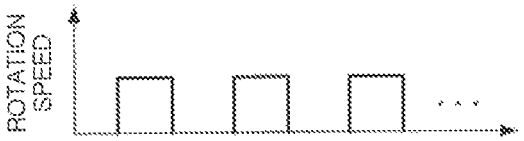
FIGS. 2A and 2B include graphs illustrating operations of a variable compressor of a dehumidifier according to an exemplary embodiment in the present invention.

Here, a refrigerant gas may also be compressed utilizing a fixed-type compressor, instead of the variable compressor 10. The fixed-type compressor compresses a refrigerant gas by rotating a driving shaft with an electric motor, and here, the driving shaft may be rotated at a uniform speed. Thus, the fixed-type compressor may implement required dehumidification performance in a manner of adjusting a driving time. In detail, as illustrated in FIG. 2A, the fixed-type compressor may be operated as follows: when an operating signal is input, power is supplied to the electric motor to perform compression on a refrigerant gas, and when inputting of the operating signal is stopped, power supply is cut off to stop compressing the refrigerant gas.

However, in the case of the fixed-type compressor, power supply and cutoff are repeatedly performed on the electric motor during a dehumidification operation, and thus, a case in which an overcurrent is instantly applied to the fixed type compressor when power is supplied or cut off may frequently occur. In this case, a power circuit breaker may cut off power supply with respect to the fixed-type compressor to prevent damage to the fixed-type compressor. However, when the power circuit breaker operates, the dehumidification operation of the dehumidifier 100 is stopped. Thus, if the power circuit breaker operates frequently, a user may feel uncomfortable in using a produce and reliability of the product may be degraded.

Also, the fixed-type compressor operates at a uniform speed, regardless of ambient temperature and humidity, which is, thus, disadvantageous in terms of energy efficiency. For example, when indoor humidity is close to target humidity, the fixed-type compressor may operate for a shore period of time and may be subsequently stopped. Thereafter, as the operation of the fixed-type compressor is stopped, indoor humidity may be immediately increased to above the target humidity. The fixed-type compressor may then operate again to lower indoor humidity to the target humidity or lower, and in this manner, the fixed-type compressor is supposed to repeatedly operate for a short period of time. That is, since the fixed-type compressor repeatedly operates in the vicinity of the target humidity, excessive power consumption may be made unnecessarily.

In addition, when the fixed-type compressor continuously operates due so high humidity, the fixed-type compressor may be overloaded, and in this case, an operation of the fixed-type compressor may be restricted for a predetermined period of time. That is, at the time when the dehumidifier 100 is urgently required to operate due to high humidity, the fixed-type compressor may not be primed to operate. In addition, in a case in which the fixed-type compressor operates at low temperatures, water condensed on a surface of the heat-exchanger 30 may be frozen, and here, in order to remove ice produced on the surface of the heat-exchanger 30, the dehumidifier 100 may not be operated for a considerable amount of time.

Figure 2B:
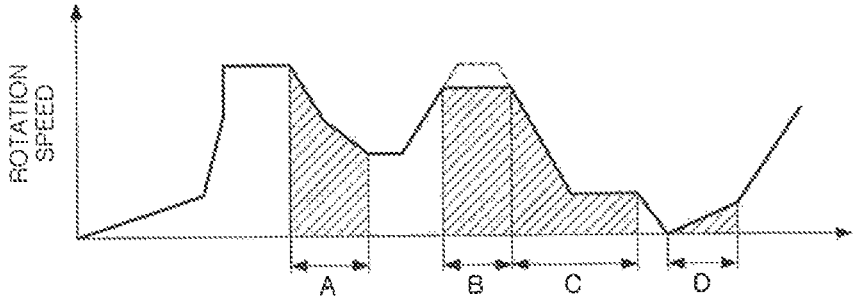

In order to solve the problems arising when the fixed-type compressor is utilized, the variable compressor 10 may be utilized. As illustrated in FIG. 2B, in the variable compressor 10, a rotation speed of the driving shaft thereof is varied, according to an input control signal, and an amount of a refrigerant gas being compressed may be controlled by adjusting the rotation speed of the driving shaft. That is, the variable compressor 10 may implement required dehumidification performance by adjusting the rotation speed of the driving shaft. Thus, the variable compressor 10 is free from a repeated operation of rapid power supply and cutoff in performing a dehumidification operation, significantly reducing sin amount of operations of the power circuit breaker, and since a degree of dehumidification may be adjusted according to indoor humidity, preventing unnecessary power consumption. In addition, when the operation of the variable compressor 10 is overloaded or ice is produced on the surface of the heat-exchanger 30, dehumidification performance may be reduced by lowering a rotation speed, allowing for continuous dehumidification. A specific operation of the variable compressor 10 is controlled according to a control signal generated by the control unit 50, and thus, a detailed control method of the variable compressor 10 will be described together with the control unit 50.

The control unit 50 may generate a control signal according to an input signal to adjust a rotation speed of the driving shaft of the variable compressor 10. Also, the control unit 30 may also adjust a driving speed of the blower motor of the blower fan 40 together with a rotation speed of the driving shaft of the variable compressor 10, The control unit 50 may be implemented by hardware such as a microprocessor, and the like.

In detail, the control unit 50 may receive an ambient humidity value measured, by an ambient humidity sensor S1, as the input signal. The ambient humidity sensor S1 may be provided in the dehumidifier 100, measure humidity of a location where the dehumidifier 100 is present, and generate an ambient humidity value corresponding to the measured humidity. Here, the dehumidifier 100 may perform a dehumidification operation so that the ambient humidity value comes within a target, humidity range (for example, 40% to 50%) set by the user. That is, humidity of the location where the dehumidifier 100 is present may be adjusted to humidity desired by the user using the dehumidifier 100. Here, when the ambient humidity value is within the target humidity range like a region A of FIG. 2B, the control unit 50 may reduce a rotation speed of the driving shaft of the variable compressor 10 to a preset humidity maintaining speed. That is, in a case in which the ambient humidity value is within the target humidity range, there is no need to additionally perform, dehumidification to lower humidity, and thus, the control unit 50 may reduce a rotation speed of the driving shaft to perform dehumidification only to a degree in which humidity is uniformly maintained. Thus, the control unit 50 may control an operation of the variable compressor 10 by outputting a maintaining control signal for adjusting a rotation speed of the driving shaft to a preset humidity maintaining speed, to the variable compressor 10.

Also, the control unit 50 may receive a measurement current value measured by the current measurement device S2, as an input signal. The current measurement, device S2 may measure a size of a current supplied to the variable compressor 10 and generate a measurement current value corresponding to the measured current value. Here, when the measurement current value is increased to above a preset cutoff current value, the power circuit breaker may operate to cut off power supply to the variable compressor 10.

However, in order to prevent an operation of the power circuit breaker, when the current applied to the variable compressor 10 is increased to above a preset overload current value (cutoff current value>overload current value), the control unit 50 may reduce a rotation speed of the driving shaft to a preset safety speed in advance as illustrated in a region B of FIG. 2B. When the rotation speed of the driving shaft is reduced, a magnitude of the current applied to the variable compressor 10 may also be reduced, thus preventing overload of the variable compressor 10. That is, before the variable compressor 10 is overloaded to cause the power circuit breaker to operate, a magnitude of the current applied to the variable compressor 10 is reduced to allow the dehumidification operation to be continued ceaselessly. In detail, when the measurement current value is above the preset overload current value, the control unit 50 may output a safety control signal for reducing the rotation speed of the driving shaft to a preset safety speed.

Also, when the measurement current value is above the preset overload current value, the control unit 50 may adjust the driving speed of the blower motor of the blower fan 40 together, as well as the rotation speed of the driving shaft of the variable compressor 10. In detail, the control unit 50 may increase a driving speed of the blower motor of the blower fan 40 to a speed, above a preset reference speed or higher to increase an amount of air introduced to the interior of the dehumidifier 10 to increase heat exchange efficiency, whereby an overload state may be promptly resolved.

In addition, the control unit 50 may receive a measurement temperature value measured by a temperature sensor S3 for measuring a surface temperature, as the input signal. Thereafter, when the measurement temperature value input to the control unit 50 is dropped to below the preset condensation temperature, the control unit 50 may reduce the rotation speed of the driving shaft to a preset anti-condensation speed. As discussed above, when the surface temperature of the heat-exchanger 30 is dropped, to below the condensation temperature, condensed water may be frozen on the surface of the heat-exchanger 30, and in this case, dehumidification performance of the heat-exchanger 30 may be rapidly degraded to half or lower. Thus, when the surface temperature of the heat-exchanger 30 is dropped to below the condensation temperature, the control unit 50 reduces the rotation speed of the driving shaft to the anti-condensation speed to maintain a surface temperature of the heat-exchanger 30 to be higher than the condensation temperature as in a region "C" of FIG. 2B. In detail, the control unit 50 may input an anti-condensation control signal to the variable compressor 10.

Also, in a case in which the measurement temperature value is lower than the preset condensation temperature, a driving speed of the blower motor of the blower fan 40 may also be adjusted together, as well as the rotation speed of the driving shaft of the variable compressor 10. In detail, the control unit 50 may increase a driving speed of the blower motor of the blower fan 40 to a speed above a preset reference speed to increase an amount of air introduced to the interior of the dehumidifier 100 to increase heat exchange efficiency, thus quickly defrosting the surface of the heat-exchanger 30.

In addition, as illustrated in a region "D" of FIG. 2B, when power supply is started to re-start the variable compressor 10, the rotation speed of the driving shaft may be restricted to a speed below a preset initial start-up speed during a preset start-up time. That is, in the case of related art fixed type compressor, in order to protect the fixed type compressor, the fixed type compressor is restarted after the lapse of a standby time of about 3 minutes. In contrast, in the case of the variable compressor 10, since the rotation speed of the driving shaft is available to be adjusted, the variable compressor 10 may be operated at a low rotation speed during a preset start-up time and immediately perform a dehumidification operation without, a standby time. Thus, when power is supplied to the variable compressor 10, the control unit 50 may output an initial start-up control signal during the preset start-up time to limit the rotation speed of the driving shaft to below the preset initial start-up speed.

MODE FOR INVENTION

Figure 3:
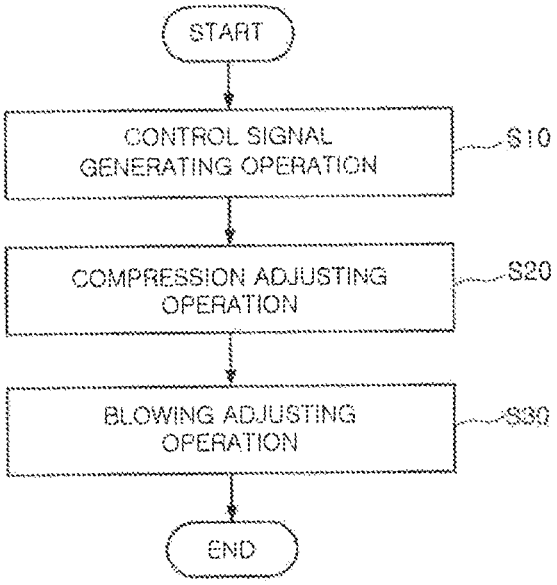
FIG. 3 is a flow chart illustrating a method for controlling an operation of a dehumidifier according to an exemplary embodiment in the present invention.

FIG. 3 is a flow chart illustrating a method for controlling an operation of a dehumidifier according to an exemplary embodiment in the present invention.

Referring to FIG. 3, a method for controlling an operation of a dehumidifier according to an exemplary embodiment may include a control signal generating operation S10 and a compression adjusting operation S20. According to circumstances, the method for controlling an operation of a dehumidifier according to an exemplary embodiment may further include a blowing adjusting operation S30. Also, the method for controlling an operation of a dehumidifier illustrated in FIG. 3 may be performed by a microprocessor, or the like, installed in a dehumidifier.

In the control signal generating operation S10, a control signal for adjusting an amount of a refrigerant gas compressed by the variable compressor according to an input signal may be generated. Also, in the control signal generating operation S10, a control signal for adjusting a driving speed of the blower motor of the blower fan, as well as the variable compressor, may be generated.

In detail, the control signal generating operation S10 may include an initial start-up process, a humidity maintaining process, a safety control process, and an anti-condensation process. These processes may be independently performed, or the order in which the processes are performed may be changed or some of the processes may be omitted.

First, in the initial start-up process, when power is supplied to the variable compressor, an initial start-up signal may be generated. The initial start-up signal may be a signal for limiting a rotation speed of the driving shaft included in the variable compressor to a speed below a preset initial start-up speed. That is, as illustrated in the region of FIG. 2B, when power starts to be supplied to the variable compressor, for example, when the variable compressor is restarted, the driving shaft may be rotated, at a speed below the preset initial start-up speed to protect the variable compressor.

In the humidity maintaining process, when an ambient, humidity value measured by an ambient humidity sensor is within a preset target humidity range, a maintaining control signal for adjusting the rotation speed, of the driving shaft to a preset humidity maintaining speed may be generated. That is, as illustrated in the region "A" of FIG. 2B, in a case in which the ambient humidity value is within the target humidity range, additional dehumidification may not be required and only current humidity may need, to be maintained, and thus, the rotation speed of the driving shaft may be reduced to reduce an amount of dehumidification.

In the safety control process, when a magnitude of a current supplied to the variable compressor is above a preset overload current value, a safety control signal for reducing the rotation speed of the driving shaft to a preset safety speed may be generated. In detail, as illustrated in the region "B" of FIG. 2B, the rotation speed of the variable compressor may be increased to adjust an ambient humidity value to the target humidity range. In general, as a rotation speed of the variable compressor is increased, an amount of compressed refrigerant, gas is increased, and thus, cooling is actively performed in a heat-exchanger to increase an amount of dehumidification. Here, however, as the rotation speed is increased, a high current is applied to the variable compressor, leading to a possibility in which an overload is applied to the variable compressor. Thus, the safety control signal for maintaining a safety speed indicated by the solid line in the region "B" of FIG. 2B, rather than increasing she rotation speed to a region indicated by the dotted line in the region "B".

Also, in the safety control process, when a magnitude of the current supplied to the variable compressor is above the preset overload current value, a control signal for increasing the driving speed of the blower motor of the blower fan to a speed above a preset reference speed may be generated. Accordingly, an amount of air introduced to the interior of the dehumidifier may be increased to increase heat exchange efficiency and an overload state may be quickly resolved.

In addition, as illustrated in the region "C" of FIG. 2B, when a measurement temperature value measured by a temperature sensor for measuring a surface temperature of the heat-exchanger is below a preset condensation temperature, an anti-condensation control signal for reducing the rotation speed of the driving shaft to a preset anti-condensation speed may be generated. In detail, when the surface temperature of the heat-exchanger is dropped to below the condensation temperature, condensed water may be frozen on a surface of the heat-exchanger, and in this case, dehumidification performance of the dehumidifier may be rapidly degraded. Thus, the anti-condensation control signal may be generated in order to reduce a rotation speed of the variable compressor to an anti-condensation speed to maintain a surface temperature of the heat-exchanger to be higher than the condensation temperature.

In the anti-condensation, process, when the measurement temperature value measured, by the temperature sensor is below the preset condensation temperature, a control signal for increasing a driving speed of a blower motor of a blower fan to a speed above a preset reference speed may be generated. Accordingly, the amount of air introduced to the interior of the dehumidifier may be increased to increase heat exchange efficiency and more quickly defrost the surface of the heat-exchanger.

In the compression adjusting operation S20, the variable compressor may vary a rotation speed of the driving shaft, according to the control signal to adjust an amount of a refrigerant gas compressed by the variable compressor. The rotation speed of the driving shaft of the variable compressor is the speed as illustrated, in FIG. 2B. The compression, adjusting operation S20 may be performed during all of the initial start-up process, the humidity maintaining process, the safety control process, and the anti-condensation process.

In the blowing adjusting operation S30, an amount of air introduced to the interior of the dehumidifier by the blower fan may be adjusted by adjusting a driving speed of the blower motor of the blower fan according to the control signal. The blowing adjusting operation S30 may be performed during the safety control process and the anti-condensation process.

While embodiments have been shown and described above, it will be apparent to those skilled in the art that modifications and variations could be made without departing from the scope of the present invention as defined by the appended claims.

The invention claimed is:

1. A dehumidifier comprising:

a variable compressor configured to adjust an amount of a refrigerant gas compressed according to rotation of a driving shaft by varying a rotation speed of the driving shaft according to an input control signal;

a condenser configured to liquefy the compressed refrigerant gas supplied by the variable compressor;

a heat-exchanger configured to vaporize the liquefied gas to cool introduced air, and to condense vapor in the introduced air into water to remove the water using the cooling air;

a blower fan configured to form an air flow according to a driving speed of a blower motor to supply ambient air to the heat-exchanger; and a control unit configured to generate the control signal according to an input signal to adjust a rotation speed of the driving shaft wherein the control unit further includes a function of being configured to adjust a driving speed of the blower motor of the blower fan by generating the control signal, wherein the control unit is configured to receive a measurement temperature value measured by a temperature sensor configured to measure a surface temperature of the heat-exchanger, as the input signal, and when the measurement temperature value is below a preset condensation temperature, the control unit is configured to output an anti-condensation control signal that is configured to reduce the rotation speed of the driving shaft to a preset anti-condensation speed and is configured to increase the driving speed of the blower motor of the blower fan to a speed above a preset reference speed.

2. The dehumidifier of claim 1, wherein the control unit is configured to receives an ambient humidity value measured by an ambient humidity sensor, as the input signal, and when the ambient humidity value is within a preset target humidity range, the control unit is configured to adjusts the rotation speed of the driving shaft to a preset humidity maintaining speed.

3. The dehumidifier of claim 1, wherein when power starts to be supplied to the variable compressor, the control unit is configured to output an initial start-up control signal for limiting the rotation speed of the driving shaft to a speed below a preset initial start-up speed during a preset start-up time.

4. The dehumidifier of claim 1, wherein the control unit is configured to receives a measurement current value measured by a current measurement device configured to measure a magnitude of a current supplied to the variable compressor, as the input signal, and when the measurement current value is above a preset overload current value, the control unit is configured to outputs a safety control signal configured to reduce the rotation speed of the driving shaft to a preset safety speed and configured to increase the driving speed of the blower motor of the blower fan to a speed above a preset reference speed.

5. A method for controlling an operation of a dehumidifier which compresses a refrigerant gas using a variable compressor, liquefies the compressed refrigerant gas with a condenser, and vaporizes the refrigerant gas with a heat-exchanger to cool introduced air to thus remove vapor from the introduced air, the method comprising:

a control signal generating operation of generating a control signal for adjusting an amount of a refrigerant gas compressed by the variable compressor according to an input signal; and a compression adjusting operation of adjusting an amount of the refrigerant gas compressed by the variable compressor by varying a rotation speed of a driving shaft by the variable compressor according to the control signal, wherein the control signal generating operation generates a control signal for adjusting an amount of a refrigerant gas compressed by the variable compressor and a driving speed of a blower motor of a blower fan according to the input signal, wherein the method further includes a blowing adjusting process in which an amount of air introduced to an interior of the dehumidifier is adjusted by adjusting the driving speed of the blower motor of the blower fan according to the control signal, wherein the control signal generating operation includes:

a safety control process in which when a magnitude of a current supplied to the variable compressor is above a preset overload current value, a safety control signal for reducing the rotation speed of the driving shaft to a preset safety speed and increasing the driving speed of the blower motor of the blower fan to a speed above a preset reference speed is generate; and an anti-condensation process in which when a measurement temperature value measured by a temperature sensor measuring a surface temperature of the heat-exchanger is below a preset condensation temperature, an anti-condensation control signal for reducing the rotation speed of the driving shaft to a preset anti-condensation speed and increasing the driving speed of the blower motor of the blower fan to a speed above a preset reference speed is generated.

6. The method of claim 5, wherein the control signal generating operation includes:

an initial start-up process in which when power starts to be supplied to the variable compressor, an initial stark-up signal for limiting the rotation speed of the driving shaft to a speed below a preset initial start-up speed during a preset start-up period is generated; and a humidity maintaining process in which when an ambient humidity value measured by an ambient humidity sensor is within a preset target humidity range, a maintaining control signal for adjusting the rotation speed of the driving shaft to a preset humidity maintaining speed is generated.

* * * * *